US005248063A

United States Patent [19]

Abbott

[11] Patent Number: 5,248,063

[45] Date of Patent: Sep. 28, 1993

[54] BARRIER PACK CONTAINER WITH INNER LAMINATED TUBE

[76] Inventor: Joe L. Abbott, 66 Hillside Rd., Cumberland, R.I. 02864

[21] Appl. No.: 947,891

[22] Filed: Sep. 18, 1992

Related U.S. Application Data

[63] Continuation of Ser. No. 622,501, Dec. 5, 1990, abandoned.

[51] Int. Cl.[5] ..... B65D 35/16

[52] U.S. Cl. ..... 222/95; 222/105; 222/107; 220/85 B; 383/109; 383/121

[58] Field of Search ..... 222/95, 105, 107, 131, 222/183, 386.5; 220/85 B; 383/109, 121

[56] References Cited

U.S. PATENT DOCUMENTS

| | | | |
|---|---|---|---|
| Re. 24,918 | 12/1957 | Mills | 222/386.5 |
| Re. 30,093 | 9/1979 | Burger | 222/95 |
| 1,625,968 | 4/1927 | Ware | 222/95 |
| 3,169,670 | 2/1965 | Hrebenak et al. | 222/95 |
| 3,240,394 | 3/1966 | Modderno | 222/95 |
| 3,323,206 | 6/1967 | Clark | 222/95 X |
| 3,346,173 | 10/1967 | Smith et al. | 383/121 |
| 3,423,818 | 1/1969 | Ruekberg | 29/451 |
| 3,433,391 | 3/1969 | Krizka et al. | 222/95 |
| 3,718,236 | 2/1973 | Reyner et al. | 222/386.5 |
| 3,896,991 | 7/1975 | Kozlowski et al. | 383/121 |
| 4,032,064 | 6/1977 | Giggard | 220/85 B |
| 4,117,951 | 10/1978 | Winckler | 220/461 |
| 4,148,416 | 4/1979 | Gunn-Smith | 222/95 X |
| 4,226,337 | 10/1980 | Abbott | 222/107 |
| 4,257,536 | 3/1981 | Hillmar | 222/107 |
| 4,265,373 | 5/1981 | Stoody | 222/94 |
| 4,293,353 | 10/1981 | Pelton et al. | 156/69 |
| 4,308,973 | 1/1982 | Irland | 222/95 |
| 4,346,743 | 8/1982 | Miller | 222/386.5 |
| 4,685,591 | 8/1987 | Schaefer et al. | 222/215 |
| 4,693,395 | 9/1987 | Tauss et al. | 222/107 |
| 5,123,560 | 6/1992 | Arzani et al. | 222/95 |
| 5,137,179 | 8/1992 | Stoffel | 222/95 |

FOREIGN PATENT DOCUMENTS

| | | | |
|---|---|---|---|
| 735288 | 5/1966 | Canada | 222/95 |
| 1153321 | 9/1983 | Canada . | |
| 9010583 | 9/1990 | PCT Int'l Appl. . | |
| 740635 | 11/1955 | United Kingdom | 222/386.5 |
| 2233396 | 1/1991 | United Kingdom | 222/105 |

*Primary Examiner*—Andres Kashnikow
*Assistant Examiner*—Kenneth Bomberg
*Attorney, Agent, or Firm*—Weingarten, Schurgin, Gagnebin & Hayes

[57] ABSTRACT

The invention provides a barrier pack dispensing container having an outer container and a laminated, inner barrier tube with at least one metal barrier layer for substantial impermeability against contamination of product by propellant. In one embodiment, the laminate core contains a layer of pinhole-free aluminum bonded to an inner layer of thermoplastic to prevent contamination of product by the metal layer. A further inner plastic layer may be used. Prior to forming the tube, a first marginal side edge of the core is covered with a bead of plastic to prevent delamination. The laminate core is curved about a mandrel to form a tube having a second marginal side edge overlapping said beaded first side edge disposed inward of the tube, and sufficient pressure is applied with heat to form a laminate joint. The tube is cut to a desired length, crimped at one end, then crimped between the collar of the outer container and valve top assembly.

17 Claims, 4 Drawing Sheets

BARRIER PACK CONTAINER WITH INNER LAMINATED TUBE

This application is a continuation of application Ser. No. 07/622,501, filed Dec. 5, 1990, now abandoned.

FIELD OF THE INVENTION

This invention relates to product dispensing containers, and more particularly to a barrier pack container having an inner laminated barrier tube.

BACKGROUND OF THE INVENTION

Barrier packaged containers, otherwise known as barrier packs, were developed as a way of separating the propellant from the product to be dispensed. Placing a bag within the can also provided an expedient way of separating the product from the aluminum container. The bag was therefore directly connected to the valve mechanism, so that the contained product could be dispensed without contacting aluminum. Bi-compartmented aerosols became a way of dispensing products free of the contaminating effects of propellants, which remained trapped outside of the compressed bag within the container.

Barrier pack containers became popular due in part to the ability to dispense product without inadvertent expenditure of propellant when tilted in non-vertical positions. Since the flowable or sprayable product is kept in contact with the dispensing valve assembly, there is less chance that product will dry or crystallize in an air gap and thereby plug the valve assembly orifice.

Along with advantages afforded by the barrier pack, however, are several disadvantages. Bags must be carefully designed and constructed for purposes of manufacture, impermeability, immunity from rupture, and ease and completeness of product expulsion. Achieving a combination of these and other desired features remains difficult. For example, fabricating a thin bag from polyethylene often means that the bag, while facilitating ease of product expulsion, may permit the propellant to permeate the bag and contaminate the product; or the bag may fold up on itself and cause blockage of product.

With respect to these concerns, U.S. Pat. Nos. 3,240,394 and 3,433,391 disclose a dispensing container comprising a collapsible inner bag of plastic material having pleats to provide an orderly collapse near the top-mounted valve assembly and to avoid blockage due to folding of the material, or "panelling." Such a design, however, involves unnecessary complexity and added expense. The pleated structure and the amassing of the thick plastic material near the top of the outer container also hinder complete product expulsion.

Laminated containers have been used for products that are manually squeezed out of single-chambered containers, but such a design involving a laminated container has not been considered or treated in the context of barrier pack containers. The tubular body portions of prior art laminated containers have typically been produced by forming a flat laminate into tubular form and heat-sealing the edges to provide a tube having a longitudinal seam. Such a heat-sealed construction necessitates heat sealing compatibility of the inner and outer layers of the laminate and thus requires both layers to be thermoplastic. Such previous methods of construction thus limit the selectivity of materials and, consequently, the use of containers employing such body constructions. Moreover, the compatibility requirements for heat sealing have made it impossible to employ thermosetting plastic materials for the inner surface of the tubular body so as to minimize product permeation.

A laminated tube for collapsible containers and a method for making such a tube has been disclosed in U.S. Pat. No. 4,226,337 and Canadian Patent No. 1,153,321, incorporated herein by reference. The laminated tube disclosed in those references avoids many of the problems of conventional heat-sealed laminated containers. The purpose of the container disclosed therein, however, is to dispense products by hand squeezing and not by the use of propellants.

A product dispensing container is therefore needed having an inner laminated barrier tube that provides for sufficiently complete and efficient expulsion of product; that provides an inexpensive design for manufacture and assembly; that affords a high degree of impermeability between product and propellant; that prevents contamination of the product; that lends sufficient resistance to rupture; that provides a strong seal between outer aluminum container, valve assembly top, and inner barrier container; and that does not waste container volume through use of thick materials or bulky construction.

SUMMARY OF THE INVENTION

The present invention provides a dispensing container with an inner laminated barrier tube-shaped container comprised of layers of plastic, such as polyethylene or polypropylenes and metal, such as pinhole-free aluminum. The invention provides a high degree of impermeability from contamination of product by the metal layer or propellant, while enabling an easy and sufficiently complete expulsion of product.

The present invention also enables the production of a collapsible barrier container body having an outer surface uninterrupted by a longitudinal heat-sealed seam, which has been a weakness of prior art laminated tube structures. It also enables the use of a wide variety of materials in producing a tubular barrier container body by avoiding the necessity for compatible thermoplastic materials to enable heat-sealing.

In one exemplary embodiment of the invention, an inner barrier tube is produced by forming a sheet or laminate of core material into a tubular configuration having circumferentially overlapping marginal side edges. The overlapped marginal side edges of the core are interlocked with the sheath material in a manner which optimizes the structural integrity of the seam. A thin bead of the sheath material may be applied along the longitudinal edge of the radially inner one of the overlapped marginal side edges prior to extrusion of the sheath material about the core. The thin bead helps to prevent delamination. Sufficient heat and pressure are applied to the overlapping marginal edges and along the bead material to form a laminate joint.

The bottom of the laminated barrier tube is sealed in one embodiment of the invention by folding edges of the open-ended tube inwardly to obtain gusset folds, which are then transversely crimped. The laminated barrier container may be sealed to the valve cup assembly and curled collar of an outer aluminum container also by crimping means.

DESCRIPTION OF THE DRAWINGS

These and other features of the present invention may be more fully understood from the following detailed description taken together with the solely exemplary drawings wherein.

DETAILED DESCRIPTION OF THE INVENTION

Reference is made to the drawings herein which depict exemplary embodiments of the invention only and not for the purpose of limiting the invention.

Figure 1:
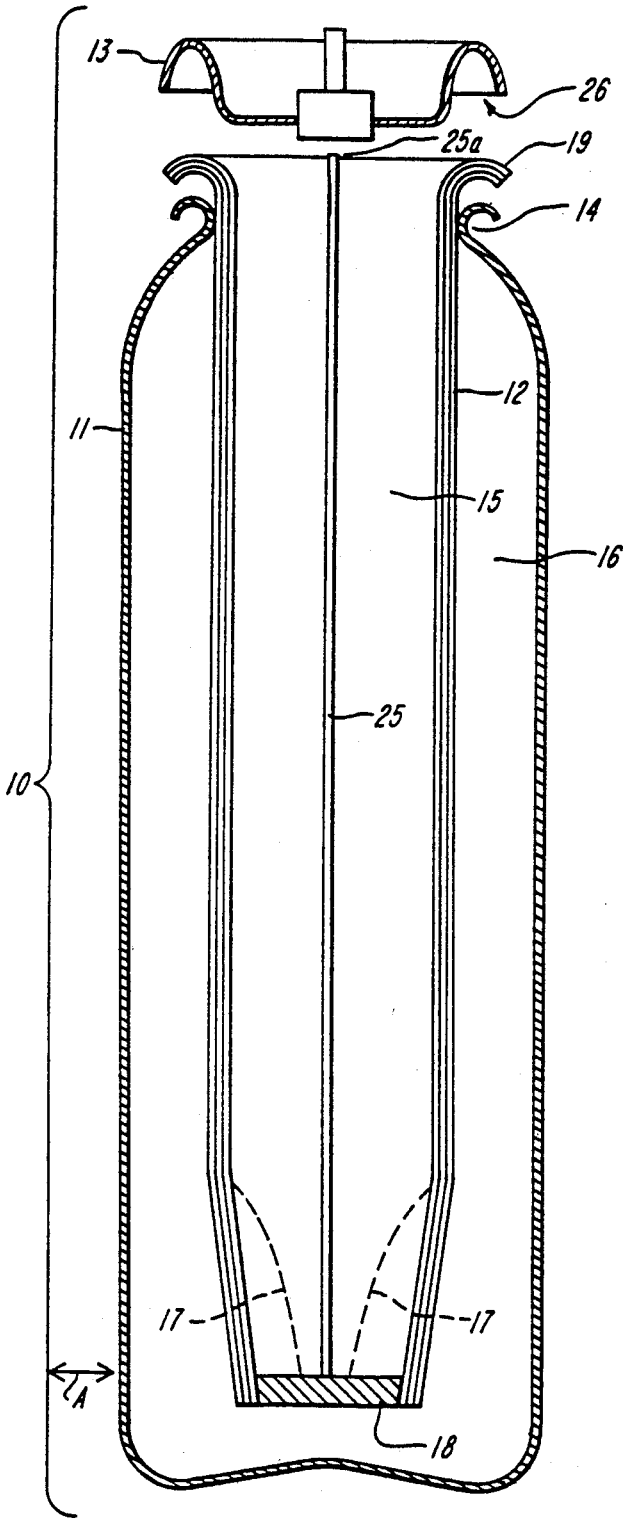
FIG. 1 is a cross-sectional view of the present invention having an outer aluminum container, a valve-assembly cup, and an inner laminated barrier tube.

FIG. 1 shows a dispensing barrier pack container generally at 10 comprising an outer aluminum container 11, an inner laminated barrier container 12 which is generally tube-shaped, and a top or valve assembly cup 13 which is crimped together at the curled annular collar 14 at the top of the aluminum container 11. A seal is formed between the outer container 11 and barrier container 12 to permit product contained in the chamber 15 within the barrier container 12 to be separated from the propellant contained in the chamber 16 between the barrier container 12 and outer aluminum container 11. The barrier container 12 is sealed 18 at the bottom by crimping transversely across gusset folds 17.

Figure 1A:
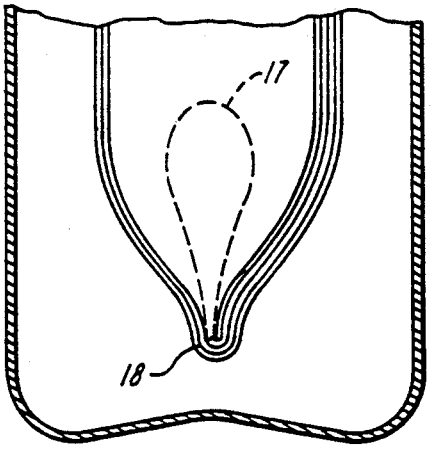
FIG. 1*a* is a view along perspective "A" of FIG. 1 showing a partial side view of the gusset folds of the barrier tube along the crimped end of the tube.

FIG. 1*a* shows the gusset folds at the bottom of the inner laminated tube 12 along perspective view "A" of FIG. 1.

The laminations of the barrier container 12 are comprised of at least one barrier layer of metal to provide impermeability to contamination of product by the propellant, and at least one plastic layer to prevent contamination of product by the metal layer. An inner and outer layer of plastic material, such as polyethylene or polypropylene, may be further used. The advantage of the present invention is that the inner and outer layers need not be made of the same material. With respect to the layers, it is advisable to use twice as much extensible material as non-extensible material (FIG. 2*a*), and preferably upwards of a three-to-one ratio of extensible to non-extensible material (FIG. 2*b*). As will be explained hereafter, the laminated tube 12 is formed by rolling a sheet of layered plastics and foil about a mandrel. A laminate joint 25, formed by overlapping opposite edges of a core laminate around a mandrel, extends throughout the laminated tube 12.

Figure 2:
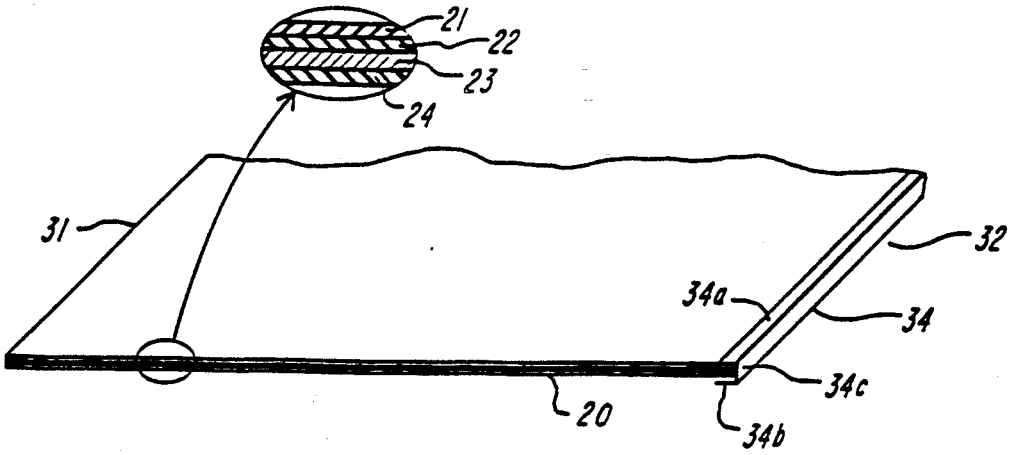
FIG. 2 is a cross-sectional view showing the core laminate having one of two marginal side edges covered by a bead.
Figure 2A:
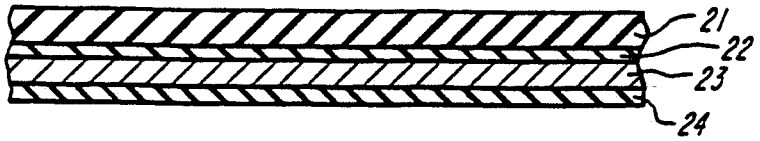
FIG. 2*a* is a partial cross-sectional view showing the core laminate having approximately twice as much extensible as non-extensible material.
Figure 2B:
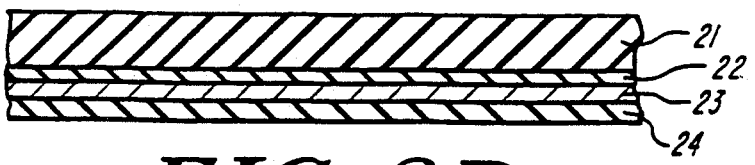
FIG. 2*b* is a partial cross-sectional view showing the core laminate having approximately three times as much extensible as non-extensible material.
Figure 3:
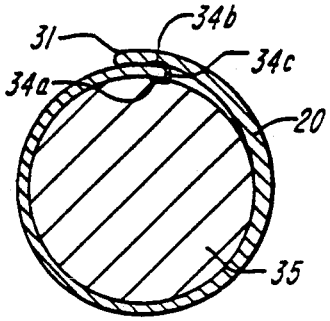
FIG. 3 is a cross-sectional view showing the core laminate formed into a tube around a mandrel.

FIG. 2 shows a magnified section of the core laminate 20. The core laminate has a barrier layer 23 of impermeable metal foil, preferably pinhole-free aluminum foil which is approximately one (1) millimeter in thickness. This barrier layer 23 is suitably bonded to a layer of thermoplastic material 22, such as ethyleneacrylic acid which is 0.5 millimeters in thickness. It is preferable to have such thermoplastic layers 22 and 24 sandwiching the foil layer 23. An innermost layer 21 may be comprised of compressible plastic such as low-density polyethylene, approximately 2 millimeters in thickness, which may be used where the stored product contains essential oils which might otherwise be absorbed by the ethyleneacrylic acid layer 22. The core laminate 20 has longitudinally extending opposite marginal side edges 31 and 32, and, as set forth more fully hereinafter, marginal edge 32 is provided with a thin bead or film of plastic material 34 after which the laminate is formed about a mandrel 35 to a tubular configuration as shown in FIG. 3. The purpose of the bead is to prevent delamination of the core when product is placed into the formed barrier tube.

More particularly, film 34 is longitudinally coextensive with marginal edge 32 and includes portion 34*a* extending laterally inward when edges 31 and 32 are overlapped about a mandrel 35 as shown in FIG. 3. The body of the core laminate is shown generally at 20.

Figure 4:
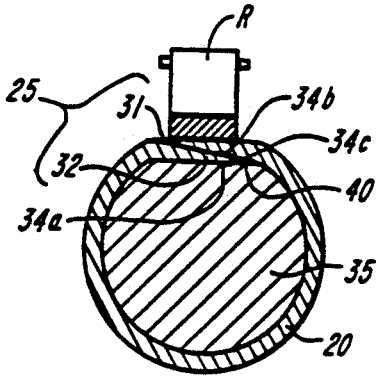
FIG. 4 is a cross-sectional view showing the core formed into a tube being sealed at a flat portion on the mandrel.

As shown in FIG. 4, overlapping edges 32 and 31 are then displaced radially against a flat 40 on the mandrel 35. Sufficient heat and pressure are then applied to form a laminate joint 25 having uniform radial thickness at the point of overlap between edges 32 and 31, which thickness is equal to the thickness of the core laminate 20.

Figure 5:
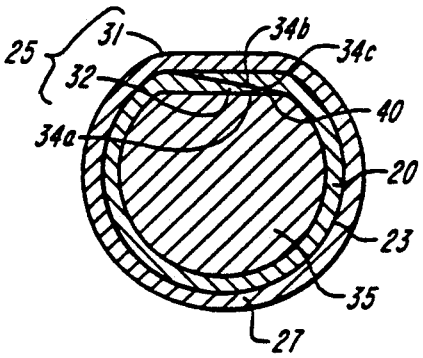
FIG. 5 is a cross-sectional view showing the tube-shaped core after extrusion of an optional sheath material thereabout.

As shown in FIG. 5, the tubular core generally designated at 20 may then be optionally encapsulated in a seamless sheath of plastic material 27 which is bonded to the outer surface of the barrier layer 23. During optional encapsulation, portion 34*b* of film 34 fuses with and becomes integral with the inner layer 21 of the tubular laminate 20. The laminate joint 25 may be further stabilized by the mechanical bond and the locking relationship, and the structural integrity of the longitudinal seam (shown at 25 in FIG. 1) along the completed container body may thereby be optimized.

Optional encapsulation avoids the necessity for heat sealing compatibility between the plastic material of the inner layer 21 and outer layer 24 of the tube to achieve a thermally bonded seam. At the same time, however, the inner and outer layers may be compatible if desired. Thus, inner and outer layers 21 and 24 in an embodiment of the laminated barrier can be like or different thermoplastics. The inner and outer layers can be selected from a wide variety of materials depending upon the particular product to be stored and dispensed from the inner barrier laminated tube.

The bead 34 is preferably of the same material as the inner layer 21. Thus, in one embodiment, it is made of polyethylene. Portions 34*a*, 34*b*, and 34*c* thereof may have each a thickness of approximately 0.5 millimeters.

Figure 6:
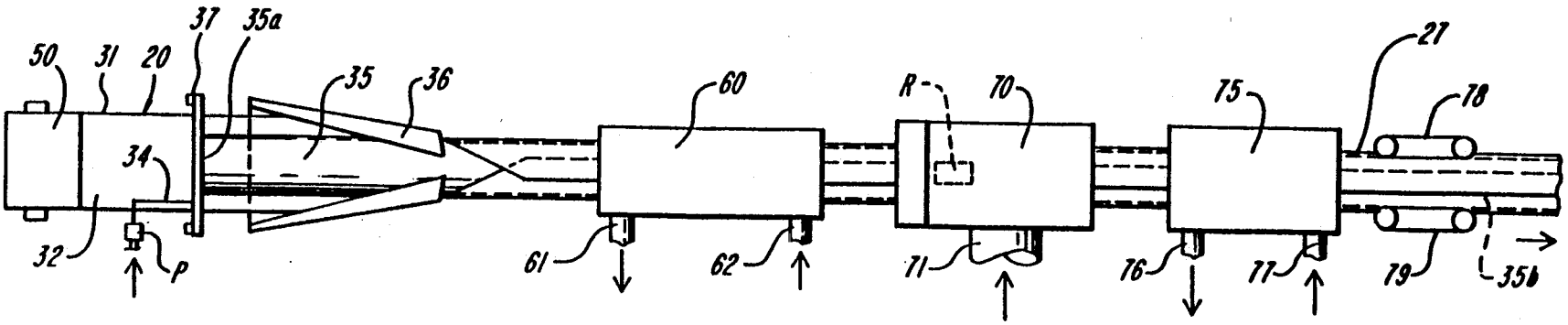
FIG. 6 is an illustration of the process whereby the core laminate may be continually formed into a tube about a mandrel, the marginal side edges are overlapped, the longitudinal seam is obtained, an optional outer plastic layer is extruded and cured, and the tube is advanced along and off the mandrel.

The laminated barrier tube body may be produced continuously, and it may be optionally encapsulated in sheath 27 by extruding the sheath 27 thereabout. FIG. 6 of the drawing schematically illustrates production of the tube in this manner. A roll 50 of the laminated core material 20 is supported at one end of the forming apparatus to provide an indeterminate length of the core material. The forming apparatus includes a circular mandrel 35, referred to hereinabove, which has an upstream end 35*a* thereof attached by welding or the like to a rigid support member 37. Mandrel 35 extends the full length of the apparatus and has a downstream terminal end 35*b*. Core material 20 is continuously fed from roll 50 to a forming plow 36 which, in a well-known manner, operates to bend material 20 into a tubular form about mandrel 35 as the core material 20 moves through the plow 36. The bead 34 is applied in the form of molten thermoplastic material to edge 32 of the core material upstream from plow 36. The bead can, for example, be applied by means of a pump P having a nozzle structured and positioned to apply the bead as shown in FIG. 2. The plastic material of bead 34 can be supplied to pump P from any suitable source and, for example, can be supplied from the source of molten plastic for the sheath extruder referred to hereinabove.

Plow 36 and mandrel 35 cooperate to form core material 20 into a tubular shape as shown in FIG. 3 of the drawing. By the time bead 30 engages the mandrel surface it has cooled sufficiently to avoid any problems of adherence of bead portion 34*b* therewith. The tubular core material then passes along mandrel 35 through a sizing ring device 60 which, as is well known, serves to bring the tubular core to a desired cross-sectional dimension—for example, one that closely fits the interior diameter of the annular collar 14 of an outer aluminum container 11. Depending on the materials of the core laminate, it may be desirable to warm the material to enhance the sizing operation and, for this purpose, sizing member 60 preferably includes a circumferentially closed housing having inlet and outlet passages 61 and 62 for circulating hot air therethrough.

If the optional sheath 27 is extruded about the tubular core, then the tubular core is passed from sizing member 60 along mandrel 35 through cross head die 70 by which outer layer 27 of plastic material is extruded onto the exterior surface of the tubular core. The material optionally extruded onto the tubular core can either be a thermoplastic or thermosetting plastic material and is fed to cross head die 70 through an inlet 71 leading from a plastic extruder, not shown. As previously mentioned, pump P for applying bead 34 to the core material can also be connected to the extruder to receive the molten plastic for the bead therefrom. Thus, in one embodiment of the invention, outer layer 27 is a thermoplastic material. Accordingly, the sheathed tube exiting from cross head die 70 passes through a cooling jacket 75 to partially cure the extruded plastic layer 27. For this purpose, jacket 75 is provided with inlet and outlet passages 76 and 77, respectively, to facilitate the circulation of a suitable cooling medium therethrough. It will be further appreciated that a heating jacket would be employed if layer 27 was a thermosetting plastic.

A suitable drive arrangement such as endless belts 78 and 79 is provided adjacent the outlet of cooling jacket 70 to facilitate driving the completed tube from the down-stream end 35*b* and mandrel 35. A suitable cut-off mechanism, not shown in FIG. 6, is preferably provided beyond the down-stream end of the mandrel to cut the finished tube into desired lengths.

While an exemplary tube structure has a layer of metal foil sandwiched between thermoplastic layers, further layers may be added. Moreover, the barrier layer 23 may be defined by a material other than metal foil such as pinhole-free aluminum as herein described. The laminate materials may be determined at least in part by the product which is intended to be dispensed.

The inner barrier tube 12 is sealed between the outer aluminum container 11 and valve assembly cup 13 by crimping means which are by now well-known in the art. This includes curling outward one end 19 of the laminated tube 12 to form a curled annular flange 19 which fits tightly between the annularly curled collar 14 of the aluminum container 11 and the inner circular rim 26 of the annular collar of the valve assembly cup 13 as shown in FIG. 1. Sufficient mechanical pressure is applied to achieve a tight seal.

Figure 7A:
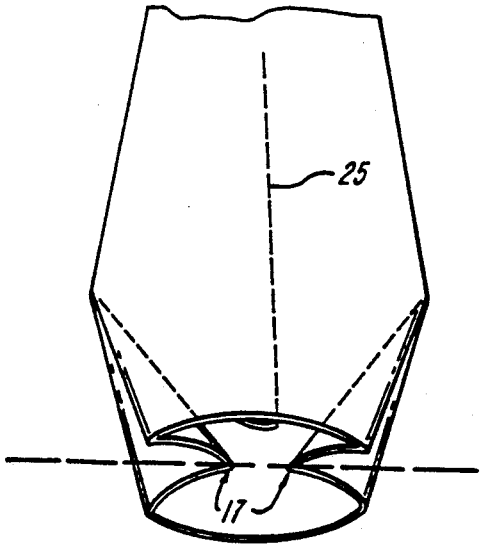
FIG. 7*a* is a perspective end-view of the gusset folds at one end of the inner barrier tube.
Figure 7B:
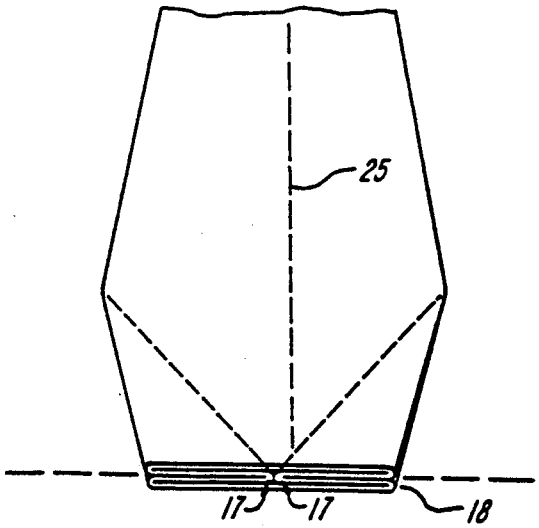
FIG. 7*b* is a perspective view of the tube end crimped across the gusset folds.

The other end of the barrier tube 12 is sealed by means known in the art. Opposite walls of the open-ended tube 12 are pinched together to form gusset folds 17, as shown in the cross-sectional view of FIG. 1, the perspective end view of FIG. 7*a*, and in the side view of FIG. 1*a*. The folds 17 are then crimped together with sufficient mechanical pressure to form a seal 18, and the excess material may be cut off and discarded. In one embodiment of the invention, the bead 34 may be aligned so as to fall in the space between gusset folds designated at 17 as shown in FIGS. 7*a* and 7*b*.

It will be understood that the outside compartment 16 of the barrier pack container of the present invention may be charged by means known in the art. Once the valve top assembly 13 is sealed with the barrier tube 12 to the outer container 11 at the collar 14, the propellant may be generated inside compartment 16 by reactants (not shown) previously placed within the chamber 16, or propellant may be introduced into the compartment 16 after the top is sealed through a rubber plug (also not shown) mounted on the outer container.

It is further expected that the laminated barrier tube will bestow further advantages to the process of introducing product into the dispensing container as a whole. For example, product can be loaded into a completed laminated barrier tube, shipped to another site, and then installed into the outer aluminum container. Unlike plastic bags, the laminated barrier tube can be constructed so that it sufficiently retains its tubular shape, when loaded with product, that is suitable for immediate loading into an awaiting aluminum outer container.

While preferred embodiments of the invention have been shown and described herein, it is to be understood by those skilled in the art that modifications may be made therein without departing from the scope and spirit of the invention.

What is claimed is:

1. A container for dispensing product comprising:

an outer container for containing propellant;

an inner laminated tube-shaped barrier container comprising:

a tube having a longitudinal seam, said seam and said tube being of substantially uniform radial thickness, the tube comprising:

a first barrier layer formed from a non-extensible metal material for preventing contamination of product by propellant contained in said outer container, and a second barrier layer formed from an extensible thermoplastic material disposed interiorly to said first metal barrier layer, said first and second barrier layers being laminated, formed into a tubular shape, and overlapped to form said longitudinal seam; and a seamless sheath surrounding said tube; and a top for mounting a valve means thereon and for sealingly engaging said outer container and said inner laminated tube-shaped barrier container.

2. The container of claim 1 wherein said first metal layer is comprised of pinhole-free aluminum.

3. The container of claim 1 wherein said inner laminated tube-shaped container has a third layer of ethyleneacrylic acid disposed outward radially of said first barrier layer.

4. The container of claim 1 wherein said sheath is formed from a material extruded about said first and second barrier layers of said inner laminated tube-shaped container.

5. The container of claim 4 wherein said sheath is polypropylene.

6. The container of claim 1 wherein:

said first barrier layer and said second barrier layer comprise a laminated sheet, said sheet having a first marginal side edge and a second marginal side edge overlapping to create said tubular shape;

a bead of plastic heat-sealed along said first marginal side edge; and said longitudinal seam comprises a laminate joint formed by crimping said overlapping marginal edges of said tube together.

7. The container of claim 1 wherein said outer container has a curled annular collar, said top has a circular rim generally corresponding to said curled annular collar for sealing engagement therewith, and said inner laminated tube-shaped barrier container has one end which is annularly flanged and curled radially outward to conform between said corresponding portions of said outer container and top to provide a seal when said portions of said top and inner and outer containers are crimped together.

8. The container of claim 1 wherein said laminated tube-shaped barrier container at one end is crimped across gusset folds.

9. The container of claim 1 wherein said laminated tube-shaped barrier container at one end is folded transversely across gusset folds and then crimped.

10. The container of claim 1 wherein said inner laminated tube-shaped barrier container is comprised of three times as much extensible material as non-extensible material.

11. The container of claim 1 wherein the second barrier layer is comprised of polyethylene.

12. The container of claim 11 further comprising a layer of ethylene acrylic acid between said first barrier layer and said second barrier layer.

13. The container of claim 1 wherein the second barrier layer is comprised of polypropylene.

14. The container of claim 13 further comprising a layer of ethylene acrylic acid between said first barrier layer and said second barrier layer.

15. The container of claim 1 further comprising a further plastic layer between said first barrier layer and said second barrier layer.

16. The container of claim 15 wherein said further plastic layer comprises ethylene acrylic acid.

17. The container of claim 1 wherein said tube is formed of at least twice as much extensible material as non-extensible material.

* * * * *